US011694584B2

(12) United States Patent
Kay et al.

(10) Patent No.: US 11,694,584 B2
(45) Date of Patent: Jul. 4, 2023

(54) RETRACTABLE STANCHION BARRIER WITH FLEXIBLE RGB DISPLAY MATRIX

(71) Applicants: Benjamin Kay, Las Vegas, NV (US); Zachariah Gambino, Las Vegas, NV (US); Hermelindo Ramirez, Las Vegas, NV (US); Victor Siemens, Ft. Wayne, IN (US)

(72) Inventors: Benjamin Kay, Las Vegas, NV (US); Zachariah Gambino, Las Vegas, NV (US); Hermelindo Ramirez, Las Vegas, NV (US); Victor Siemens, Ft. Wayne, IN (US)

( * ) Notice: Subject to any disclaimer, the term of this patent is extended or adjusted under 35 U.S.C. 154(b) by 0 days.

(21) Appl. No.: 17/666,497

(22) Filed: Feb. 7, 2022

(65) Prior Publication Data

US 2022/0157206 A1 May 19, 2022

Related U.S. Application Data

(63) Continuation-in-part of application No. 16/785,323, filed on Feb. 7, 2020, now Pat. No. 11,282,415.

(60) Provisional application No. 62/821,390, filed on Mar. 20, 2019.

(51) Int. Cl.

| | |
|---|---|
| ***G09F 9/30*** | (2006.01) |
| ***E01F 13/02*** | (2006.01) |
| ***F21V 21/14*** | (2006.01) |
| *F21Y 115/10* | (2016.01) |
| *F21Y 105/10* | (2016.01) |
| *F21Y 107/70* | (2016.01) |

(52) U.S. Cl.

CPC ..... *G09F 9/301* (2013.01); *E01F 13/028* (2013.01); *F21V 21/14* (2013.01); *F21Y 2105/10* (2016.08); *F21Y 2107/70* (2016.08); *F21Y 2115/10* (2016.08)

(58) Field of Classification Search

CPC .... G09G 3/035; G09G 2380/02; G09F 9/301; G09F 15/0062; E01F 13/028; F21Y 2105/10; F21Y 2107/70; F21Y 2115/10

See application file for complete search history.

(56) References Cited

U.S. PATENT DOCUMENTS

| | | | | |
|---|---|---|---|---|
| 9,651,230 | B1 * | 5/2017 | Girolami | F21V 21/005 |
| 11,282,415 | B2 * | 3/2022 | Kay | G09F 9/301 |
| 2010/0288990 | A1 * | 11/2010 | McPherson | E01F 13/028 256/65.01 |

(Continued)

FOREIGN PATENT DOCUMENTS

| | | | | |
|---|---|---|---|---|
| WO | WO-2014098550 | A1 * | 6/2014 | G09F 9/301 |

*Primary Examiner* — Joe H Cheng

(74) *Attorney, Agent, or Firm* — The Thornton Firm, LLC

(57) ABSTRACT

A retractable stanchion barrier system with a flexible RGB display matrix utilizes one or more stanchion units, each stanchion unit comprising a stanchion head, a weighted base, a stanchion post, and a flexible LED stanchion ribbon display which extends from each stanchion head. A computer system governs the operation of the flexible RGB display. The flexible LED stanchion ribbon display may extend from one stanchion head and connect to another stanchion head. The stanchion heads may mount to walls, doors or stanchion posts. Such a system may be configured to be ultra-portable or implemented as a fixture. A method for crowd control and line management using a stanchion display system utilizing one or more stanchion units is also recited.

11 Claims, 10 Drawing Sheets

(56) References Cited

U.S. PATENT DOCUMENTS

| | | | | |
|---|---|---|---|---|
| 2012/0084123 | A1* | 4/2012 | Pajic | G06Q 30/0241 345/163 |
| 2012/0119907 | A1* | 5/2012 | Teuchert | G08B 5/006 340/541 |
| 2014/0268532 | A1* | 9/2014 | Nicol | G09F 9/301 361/749 |
| 2016/0326705 | A1* | 11/2016 | Torsiello | E01F 9/60 |
| 2017/0060183 | A1* | 3/2017 | Zhang | G06F 1/1615 |
| 2017/0091340 | A1* | 3/2017 | Yoon | G06F 3/04883 |
| 2018/0049330 | A1* | 2/2018 | Malik | H05K 5/0017 |

* cited by examiner

RETRACTABLE STANCHION BARRIER WITH FLEXIBLE RGB DISPLAY MATRIX

CROSS-REFERENCE TO RELATED APPLICATIONS

The present utility patent application claims priority benefit of the U.S. provisional application for patent Ser. No. 62/821,390 titled "Retractable Stanchion Barrier With Flexible RGB Display Matrix," filed on Mar. 20, 2019 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

THE THORNTON FIRM, LLC
9205 West Russell Road, Suite 240
Las Vegas, Nev. 89148
Telephone (702) 793-4584

BACKGROUND OF THE INVENTION

1. Field of the Invention

The invention relates generally to pedestrian barriers. More particularly, the invention is directed towards a retractable stanchion barrier with a flexible LED RGB display matrix.

2. Description of the Related Art

Pedestrian barriers are known in the art. In the field of pedestrian flow management, a stanchion comprises an upright bar or post which may include retractable belts, velvet ropes, or plastic chains. Stanchion systems may be used in conjunction with wall-mounted barrier devices, barricades, and printed signage. Stanchion barriers are often used for crowd control, effective people flow at large events or security checkpoints, as well as construction site safety.

Retractable belt stanchions are an extremely popular form of pedestrian flow management. These crowd control barriers are designed to guide pedestrians towards an event or through a line queue. Examples of retractable belt stanchions may be found nearly everywhere in modern society.

The mechanics of a retractable belt stanchion system generally relate to the stanchion head that houses a retractable belt. Typical examples include a spring-loaded stanchion head that retracts an extended belt back into the housing for storage or to create a break in a line queue. Similar retractable belt stanchions systems may function without traditional stanchions. Wall mounted retractable belts are secured to a wall or some stationary object to close down specific areas. Such retractable belt barriers are commonly used in manufacturing and warehouse environments as well has hospitals and power plants.

Pedestrian advertising stanchion systems may use a rigid panel design to provide for fully integrated branding and marketing signage. In such systems, a graphic sign can be attached onto a stanchion system in lieu of ropes or belts. Such systems allow for full control over the path and flow of customer traffic while allowing a property owner or manager to provide for direct advertising to pedestrian traffic. These stanchion advertising banners provide an incredible branding opportunity in addition to sleek and modern crowd control.

The use of LED (light emitting diode) display systems is well known in the art. LED panel displays can be found on public transport departure indicators and many other devices requiring a simple alphanumeric (and/or graphic) display device of limited resolution. A typical LED display consists of a dot matrix of LED lights arranged in a rectangular configuration (other shapes are also possible, although not common) such that by switching on or off selected lights, text or graphics can be displayed. A computer controller converts instructions from a processor into signals which turns on or off indicator elements in the matrix so that the required display is produced.

Presently, there exists a need for a customizable LED display system which is incorporated into a retractable belt stanchion system that is flexible and designed to withstand repeated rolling and unrolling through a stanchion head with a rewind spring mechanism.

SUMMARY

The object of the present invention is to provide an improved stanchion system that includes a retractable belt stanchion barrier with a flexible LED RGB display matrix that is flexible and designed to withstand repeated rolling and unrolling through a stanchion head with a rewind spring mechanism. It is a further object of the present invention to provide a low-cost, high-visibility pedestrian barrier capable of being transported and easily set up. It is another object of the present invention to provide a programmable system for providing important, high-visibility information for persons having to stand in lines or pass through pedestrian traffic managed locations such as security checkpoints.

At its essence, the retractable stanchion barrier system with a flexible RGB display matrix utilizes one or more stanchion units, each stanchion unit comprising a stanchion head, a weighted base, a stanchion post, and a flexible LED stanchion ribbon display which extends from each stanchion head. In embodiments of the invention, the flexible LED stanchion ribbon display may extend from one stanchion head and connect to another stanchion head. Such a system is designed to be ultra-portable where rigid display systems are neither desirable nor feasible to implement.

As a retractable barrier system, the invention may include a retractable LED barrier system comprising a reel case, a LED ribbon reel body, a retraction spring, a power supply, a computer system, and a LED ribbon display system which extends from and retracts into the said reel case. Such an embodiment of the invention may function independently of a stanchion and may be mounted to objects such as, but not limited to, doors or walls. Such a system could feasibly include greater lengths of LED ribbon display when implemented as a permanent fixture.

The retractable belt stanchion barrier with a flexible LED RGB display matrix may be used for quickly providing important, high visibility information. This information may include information related to dangerous conditions, directions to specific locations, the estimated time of arrival from a specific point, and information related to specific locations. Non limiting examples include airport security lines, sporting events, night clubs, conventions, emergency shelters, or anywhere where large crowds of people are required to pass through lines and/or checkpoints.

The retractable belt stanchion barrier with a flexible LED RGB display matrix may also be used as a high visibility advertising system. Such a system could be used at shopping centers, malls, or anywhere capable of capturing the eyes of passers by.

BRIEF DESCRIPTION OF THE DRAWINGS

The invention directed by way of example, and not by way of limitation, in the figures of the accompanying drawings and in which like reference numerals refer to similar elements and in which.

Figure 1:
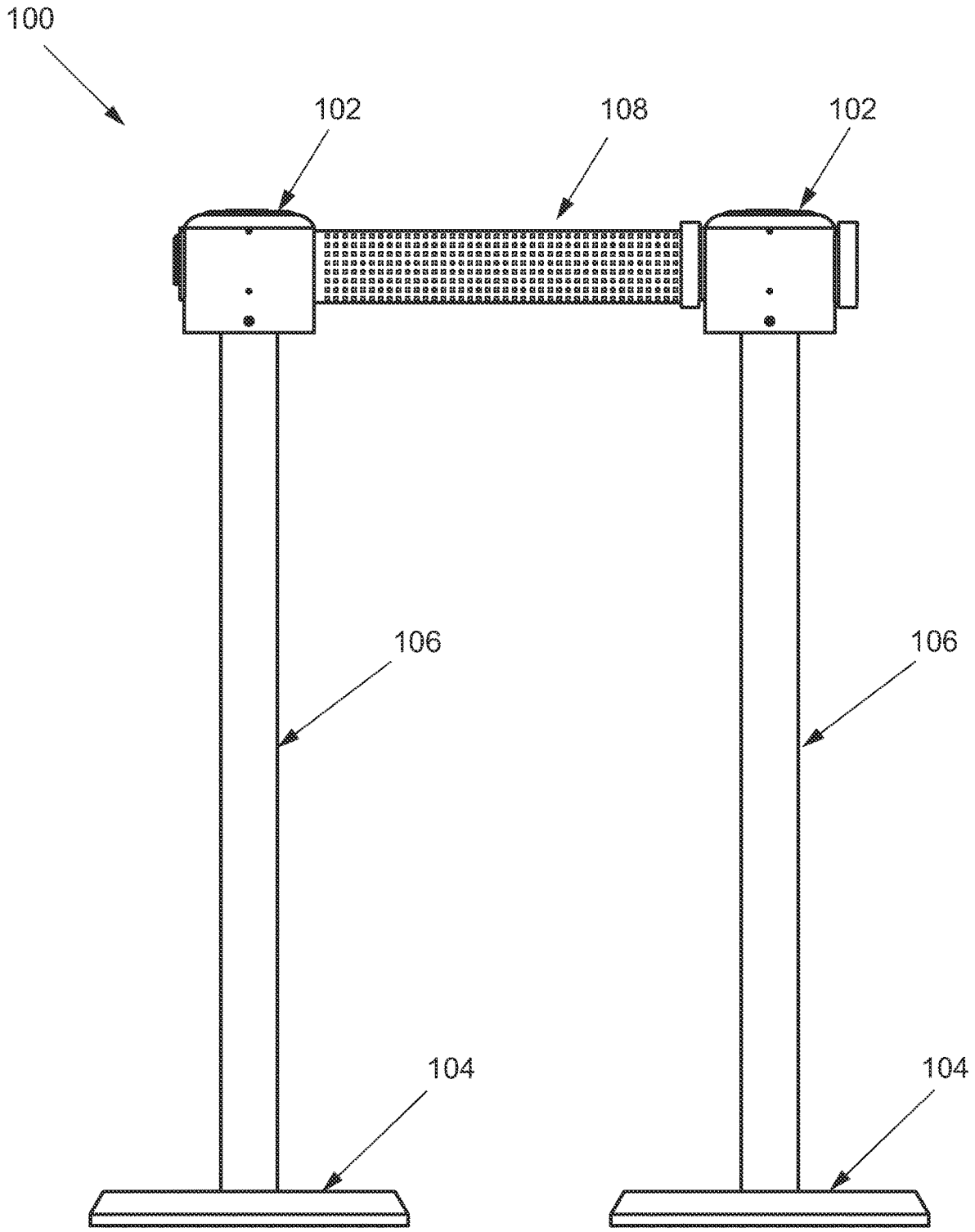
FIG. 1 illustrates a front elevation detail view of a retractable stanchion barrier system in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "an embodiment," "various embodiments," etc., may indicate that the embodiment(s) of the invention so described may include particular features, structures, or characteristics. However, not every embodiment necessarily includes the particular features, structures, or characteristics. Further, repeated use of the phrase "in one embodiment," or "in an exemplary embodiment," do not necessarily refer to the same embodiment although they may. A description of an embodiment with several components in communication with each other does not imply that all such components are required. On the contrary, a variety of optional components are described to illustrate the wide variety of possible embodiments of the present invention.

As is well known to those skilled in the art, many careful considerations and compromises typically must be made when designing for the optimal manufacture of a commercial implementation of such a retractable stanchion barrier with flexible RGB display matrix. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

A "computer" may refer to one or more apparatus and/or one or more systems that are capable of accepting a structured input, processing the structured input according to prescribed rules, and producing results of the processing as output. Examples of a computer may include: a personal computer (PC); a stationary and/or portable computer; a computer having a single processor, a computer having multiple processors, or a computer having multi-core processors, which may operate in parallel and/or not in parallel; a general purpose computer; a supercomputer; a mainframe; a super mini-computer; a mini-computer; a workstation; a micro-computer; a server; a client; an interactive television;

a web appliance; a telecommunications device with internet access; a hybrid combination of a computer and an interactive television; a portable computer; a tablet personal computer; a personal digital assistant (PDA); a portable telephone; a portable smartphone; wearable devices such as smartwatches; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

The term "processor" may refer to any device or portion of a device that processes electronic data from registers and/or memory to transform that electronic data into other electronic data that may be stored in registers and/or memory. A "computing platform" may comprise one or more processors.

A "computer monitor" or "display" is an output device that displays information in pictorial form. A monitor usually comprises the display device, circuitry, casing, and power supply. Persons skilled in the art will appreciate that the display device in modern monitors or displays typically consists of a thin film transistor liquid crystal display (TFT-LCD) with LED backlighting having replaced cold-cathode fluorescent lamp (CCFL) backlighting. Older monitors used a cathode ray tube (CRT). Monitors may be connected to the computer via numerous means such as, but not limited to, VGA, Digital Visual Interface (DVI), HDMI, DisplayPort, Thunderbolt, low-voltage differential signaling (LVDS) or other proprietary connectors and signals.

An "algorithm" is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

It will be readily understood by persons skilled in the art that the various methods and algorithms described herein may be implemented by appropriately programmed computers and computing devices. Typically, a processor (e.g., a microprocessor) will receive instructions from a memory or like device, and execute those instructions, thereby performing a process defined by those instructions. Further, programs that implement such methods and algorithms may be stored and transmitted using a variety of known media.

"Software" may refer to prescribed rules and/or instructions used to operate a computer. Examples of software may include: code segments in one or more computer-readable languages; graphical and or/textual instructions; applets; pre-compiled code; interpreted code; compiled code; and computer programs.

An "operating system" or "OS" is software that manages computer hardware and software resources and provides common services for computer programs. Non-limiting examples of operating systems include Microsoft Windows®, MacOS® by Apple Computer, Inc., and varieties of Linux.

The example embodiments described herein can be implemented in an operating environment comprising computer-executable instructions (e.g., software) installed on a computer, in hardware, or in a combination of software and hardware. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software program code for carrying out operations for aspects of the present invention can be written in any combination of one or more suitable programming languages, including an object oriented programming languages and/or conventional procedural programming languages, and/or programming languages such as, for example, Hypertext Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Smalltalk, Perl, UNIX Shell, Visual Basic or Visual Basic Script, Virtual Reality Markup Language (VRML), ColdFusion™, SQL, Python, or other compilers, assemblers, interpreters or other computer languages or platforms.

A "computer-readable medium" may refer to any storage device used for storing data accessible by a computer. Examples of a computer-readable medium may include: a magnetic hard disk; a floppy disk; an optical disk, such as a CD-ROM and a DVD; a magnetic tape; a flash memory; a memory chip; and/or other types of media that can store machine-readable instructions thereon.

A "non-transitory computer readable medium" includes, but is not limited to, a hard drive, compact disc, flash memory, volatile memory, random access memory, magnetic memory, optical memory, semiconductor-based memory, phase change memory, optical memory, periodically refreshed memory, and the like; however, the non-transitory computer readable medium does not include a pure transitory signal per se.

A "computer system" may refer to a system having one or more computers, where each computer may include a computer-readable medium employing software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a plurality of computers and associated devices that may be connected by communication channels to facilitate communication and resource sharing. A network may involve permanent connections such as cables or temporary connections such as those made through telephone, cable, Universal Serial Bus (USB), wireless or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include, but are not limited to, an internet, such as the Internet or World Wide Web; an intranet; a personal area network (PAN); near field communication (NFC); a local area network (LAN); a wide area network (WAN); a virtual private network (VPN); internet of things (IoT); Blockchain; and a combination of networks, such as an internet and an intranet.

Exemplary networks may operate with any of a number of protocols such as, but not limited to, Transmission Control Protocol (TCP), Internet protocol (IP), Internet Address Protocol (IP Address), asynchronous transfer mode (ATM), Near Field Communication digital protocol, and/or synchronous optical network (SONET), user datagram protocol (UDP), IEEE 802.x, etc.

"Video" may refer to motion pictures represented in analog and/or digital form. Examples of video may include television, movies, image sequences from a camera or other observer, and computer-generated image sequences. Video may be obtained from, for example, a live feed, a storage device, an IEEE 1394-based interface, a video digitizer, a computer graphics engine, or a network connection.

A light-emitting diode (LED) is a semiconductor light source that emits light when current flows through it. In a LED, electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light may be obtained by using multiple semiconductors or a layer of light-emitting phosphor on the semiconductor device. LEDs have many advantages over incandescent light sources, including lower energy consumption, longer lifetime, improved physical robustness, smaller size, and faster switching. Light-emitting diodes are used in a growing number of applications such as aviation lighting, automotive headlamps, advertising, general lighting, traffic signals, camera flashes, lighted wallpaper and medical devices.

Tri-color LEDs contain three different LED emitters in one case. Each emitter is connected to a separate lead so they can be controlled independently. A four-lead arrangement is typical with one common lead (anode or cathode) and an additional lead for each color. Others, however, have only two leads (positive and negative) and have a built-in electronic controller. RGB LEDs consist of one red, one green, and one blue LED. By independently adjusting each of the three, RGB LEDs are capable of producing a wide color gamut. Unlike dedicated-color LEDs, however, these do not produce pure wavelengths. Modules may not be optimized for smooth color mixing.

Embodiments of the retractable stanchion barrier with a flexible LED RGB display matrix may include more than one apparatus for performing the operations disclosed herein. An apparatus may be specially constructed for the desired purposes, or it may comprise one or more general-purpose devices selectively activated or reconfigured by a program stored in the device. Moreover, embodiments of the retractable stanchion barrier with a flexible LED RGB display matrix may employ differing shapes and sizes to achieve a customized look.

Embodiments of the retractable stanchion barrier with a flexible LED RGB display matrix may also be implemented in, or in a combination of, hardware, firmware, and software. Certain embodiments may be implemented as instructions stored on a machine-readable medium, which may be read and executed by a computing platform to perform operations to be carried out by the invention.

Unless specifically stated otherwise, and as may be apparent from the following description and claims, it should be understood that throughout this application's specification, descriptions utilizing terms such as "processing," "computing," "calculating," "determining," or the like, refer to the actions and/or processes of a computer, computing system, or any similar electronic computing device which manipulates and/or transforms data represented as physical quantities within the computing system's registers and/or memories into other data similarly represented as physical quantities within the computing system's memories, registers or other such information storage, transmission or display devices.

Aspects of the exemplary retractable stanchion barrier with a flexible LED RGB display matrix will be described below with reference to flowchart illustrations and/or block diagrams of methods, steps, apparatus (systems) and computer program products according to embodiments of the invention. Persons skilled in the art will understand that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The flowchart and block diagrams in the figures illustrate the architecture, functionality, and operation of possible implementations of systems, methods and computer program products according to various embodiments of the exemplary retractable stanchion barrier with a flexible LED RGB display matrix. It will become readily apparent to persons skilled in the art that each block in the flowchart or block diagrams may represent a module, segment, or portion of code, which comprises one or more executable instructions for implementing the specified logical function(s). It will also be readily apparent to persons skilled in the art that in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any practical order.

It will also be understood by persons skilled in the art that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram blocks.

When a single device or article is described herein, it will be readily apparent to persons having skill in the art that more than one device or article or/machine (whether or not they cooperate) may be used in place of a single device or article or machine. Similarly, where more than one device or article or machine is described herein (whether or not they cooperate), it will be readily apparent that a single device/article may be used in place of the more than one device or article. Likewise, the functionality and/or the features of a device or article or machine may be alternatively embodied by one or more other devices or articles or machines which are not explicitly described as having such functionality and/or features. Thus, other embodiments of the present invention need not include a specific device in and of itself.

As is well known to those skilled in the art, many careful considerations and compromises typically must be made when designing the optimal manufacture or commercial implementation of such a retractable stanchion barrier with a flexible LED RGB display matrix. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary retractable stanchion barrier system with flexible RGB matrix will now be described in detail with reference to embodiments thereof as illustrated in the accompanying drawings.

FIG. 1 illustrates a front elevation detail view of a retractable stanchion barrier 100 with flexible RGB display matrix in accordance with an embodiment of the invention. In one embodiment of the invention, a retractable stanchion barrier system with flexible RGB matrix utilizes one or more stanchion units, each stanchion unit comprising a stanchion head 102, a weighted base 104, a stanchion post 106, and a flexible LED stanchion ribbon display 108 which extends from each stanchion head. In one embodiment of the invention, the stanchion head assembly may be assembled with the stanchion head 202 being mounted to the top of the stanchion base using screws through the tubing of the stanchion post 104 into the stanchion head 102. In alternative embodiments of the invention, the stanchion head 102 may be referred to as a reel case.

In embodiments of the invention, the flexible LED stanchion ribbon display 108 may extend from one stanchion head 102 and connect to another stanchion head 102. In alternative embodiments of the invention which do not include stanchion units, the stanchion head may be referred to as a reel case unit 102. In an embodiment of the invention, each stanchion head may simply connect to another stanchion head through a simple male/female mechanism known and appreciated in the art. In another embodiment of the invention, the flexible LED stanchion ribbon display 108 extending from a stanchion head 102 is connected to another stanchion head 102, the flexible LED stanchion ribbon display may serve as an electrical and/or signal connection between stanchion heads with male/female connectors in the stanchion heads configured in such a way to create a network between stanchion heads. In other embodiments of the invention, the stanchion head 102 can be used without the weighted base 104 and the stanchion post 106. In such embodiments, the stanchion head, or alternatively called the reel case, 102 could be attached to a wall or door through the use of mounting assembly systems well known and appreciated in the art.

Figure 2:
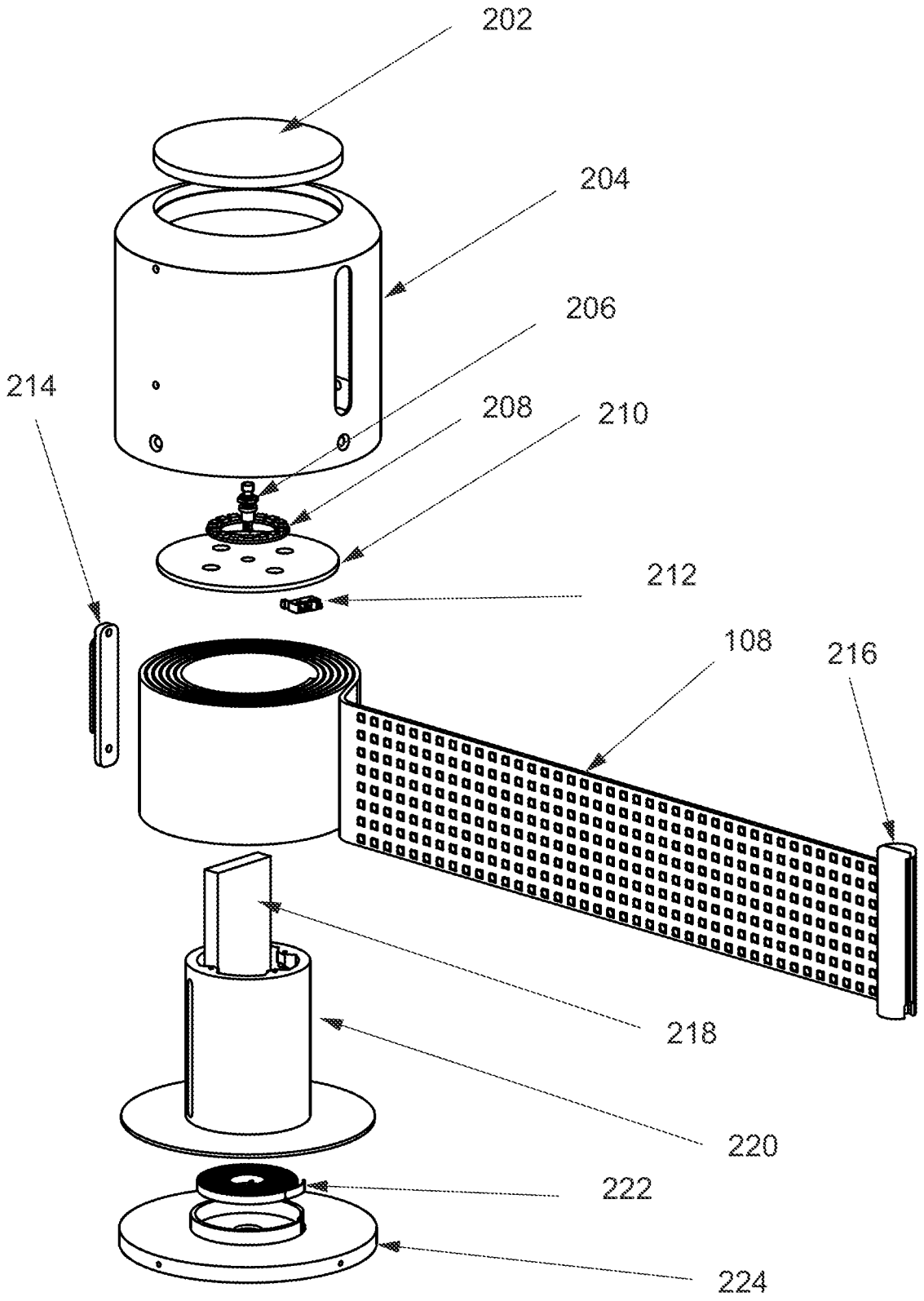
FIG. 2 illustrates an exploded perspective view of a stanchion head with an extended flexible RGB display matrix in accordance with an embodiment of the invention

FIG. 2 illustrates an exploded perspective view of a stanchion head with an extended flexible RGB display matrix in accordance with an embodiment of the invention. In one embodiment of the invention, the stanchion head 102 comprises a translucent cap top 202, a reel case 204, a reset switch 206, a RGB LED color ring 208, a reel cap 210, a feed length detection switch 212, a male stanchion ribbon connection 214, a female stanchion ribbon connection 216, a flexible LED stanchion ribbon display 108, a computer system 218, a ribbon reel body 220, a retraction or recoil spring 222, and a spring cup and pole mount 224. In alternative embodiments of the invention which do not include stanchion units, the stanchion head may be referred to as a reel case unit 102. Persons having skill in the art will readily appreciate that the feed length switch 212 may employ any mechanism such as, but not limited to, sensors which determine the length and position of the flexible LED stanchion ribbon display.

In one embodiment of the invention, the stanchion head 102 will include a top cap 202 made from a translucent material that will allow the said material to be lit up and change colors. In one embodiment, the translucent material is a plastic such as, but not limited to, high density polyethylene (HDPE). Such a top cap may function as an indicator for status (network, system, battery) and to accent messages displayed on the flexible LED stanchion ribbon display 108. In some embodiments, the stanchion head can have a logo imprinted on the top. In some embodiments of the invention, the stanchion head may use a RGB LED color ring 208 positioned beneath the top cap 102.

In embodiments of the invention, the stanchion head includes a reset switch 206 which allows the unit to be rebooted, displays battery status, or can be used to put the stanchion head into service or pairing mode. Persons skilled in the art will readily appreciate that such a reset switch may serve as a user interface for a computer system 218. The location of the reset switch 206 may vary from one embodiment of the invention to another. Persons skilled in the art will readily appreciate that the reset switch 206 may be used to perform other functions associated with the retractable stanchion barrier with a flexible LED RGB display matrix. A feed length detection switch 212 is used to detect how much of the flexible LED stanchion ribbon display has been extended from the stanchion head. In alternate embodiments of the invention, a rotary sensor system may be used to determine how many degrees the stanchion reel body 220 has spun. In alternate embodiments of the invention, a more advance user interface may be configured to each stanchion head.

Each unit of the retractable stanchion barrier with flexible RGB display matrix employs a male stanchion ribbon connection 214 and a female stanchion ribbon connection 216. The male stanchion ribbon connection 214 can be attached to any or all the three sides to allow another stanchion to connect the end of the ribbon to it. The female stanchion ribbon connection 216 is positioned at the distal or terminal end of the flexible LED stanchion ribbon display 108, and, in various embodiments of the invention, slides over the male connector. The female stanchion ribbon connection 216 may contain a power connector to allow connected stanchions to be powered through the ribbon. In alternate embodiments of the invention, the male stanchion ribbon connection 214 is positioned at the distal or terminal end of the flexible LED stanchion ribbon display 108, and the female stanchion ribbon connection 216 can be attached to any or all the three sides to allow another stanchion to connect the end of the ribbon to it. Persons skilled in the art will readily understand that there are numerous male and female connection systems which the present invention may employ.

The retraction or recoil spring 222 is inserted into the stanchion spring cup and pole mount 224. The ribbon reel body 220 is placed on top of the stanchion spring cup and pole mount 224, with the center of the retraction or recoil spring 222 inserted into the empty space at the bottom of the ribbon reel body 220. The use of a retraction or recoil spring 222 will apply retraction tension to the ribbon reel body 220 as the flexible LED stanchion ribbon display 108 is pulled from the ribbon reel body 220.

The computer system 218 and associated wiring are then inserted into the ribbon reel body 220, and wiring is fed through the hole at the bottom of the ribbon reel body 220, into the steel tube of the stanchion base. Persons having skill in the art will appreciate that one of numerous power supplies may be selected to operate the electronic components. The reset switch 206 and RGB LED color ring 208 are mounted to the reel cap 210, and the reel cap 210 is then mounted to the ribbon reel body 220. The flexible LED stanchion ribbon display 108 is connected to the computer system 218 then wound around the ribbon reel body 220. The feed length detection switch 212 is attached to the reel case 204. The reel case 204 then fits over the assembled parts and attached to the stanchion spring cup and pole mount 224 with screws. The ribbon reel body 220 is held in place as the flexible LED stanchion ribbon display 108 is pulled out of the device because the reel cap 210 acts as a guide inside the top of the reel case 204. After assembly, the end of the flexible LED stanchion ribbon display 108 is pulled out of the reel case 204, then attached to the female ribbon connector. The ribbon reel body 220 will may accommodate varying lengths of ribbon. In one embodiment, the ribbon reel body 220 will accommodate six feet of ribbon.

Figure 3:
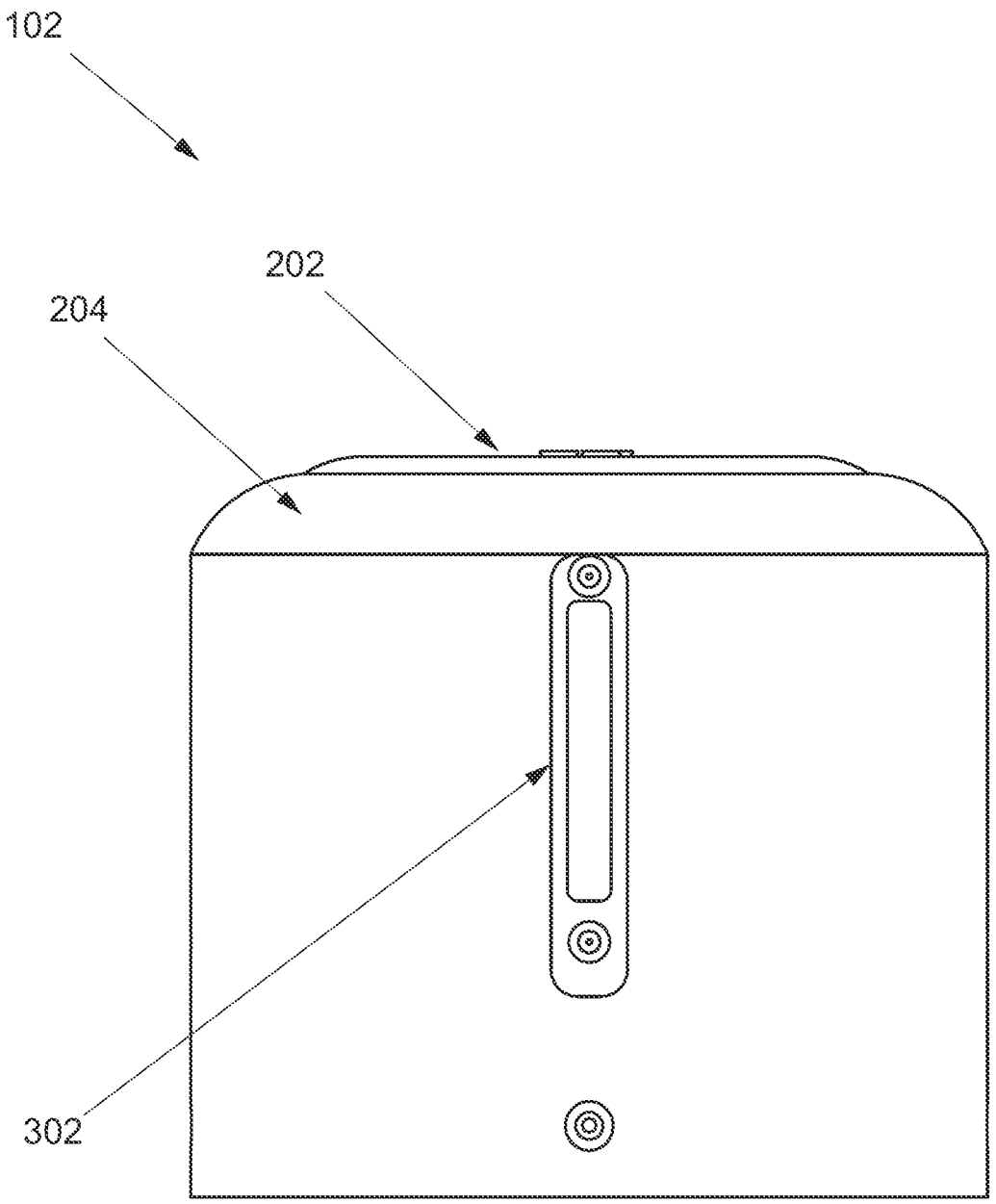
FIG. 3 illustrates a side elevation detail view of stanchion head in accordance with an embodiment of the invention.

FIG. 3 illustrates a side elevation detail view of stanchion head 102 in accordance with an embodiment of the invention. In embodiments of the invention, the outer component of the stanchion head is a reel case 204. In alternative embodiments of the invention which do not include stanchion units, the stanchion head may be referred to as a reel case unit 102. The reel case 204 has a slot 302 on one side from which the flexible LED stanchion ribbon display may be extended from and retracted into the stanchion head 102. On the opposite side of the reel case 204 is a slot for receiving the extended end of a flexible LED stanchion ribbon display.

Persons having skill in the art will appreciate that the reel case may be made from numerous materials such as, but not limited to, impact resistant, molded, plastics such as, but not limited to, acrylonitrile butadiene styrene (ABS). In alternative embodiments, polished metals or polished metal alloys may be used to create a more sophisticated appearance. The stanchion head's reel case, though functional by design, may assume different ornamental appearances depending on user demand.

Figure 4:
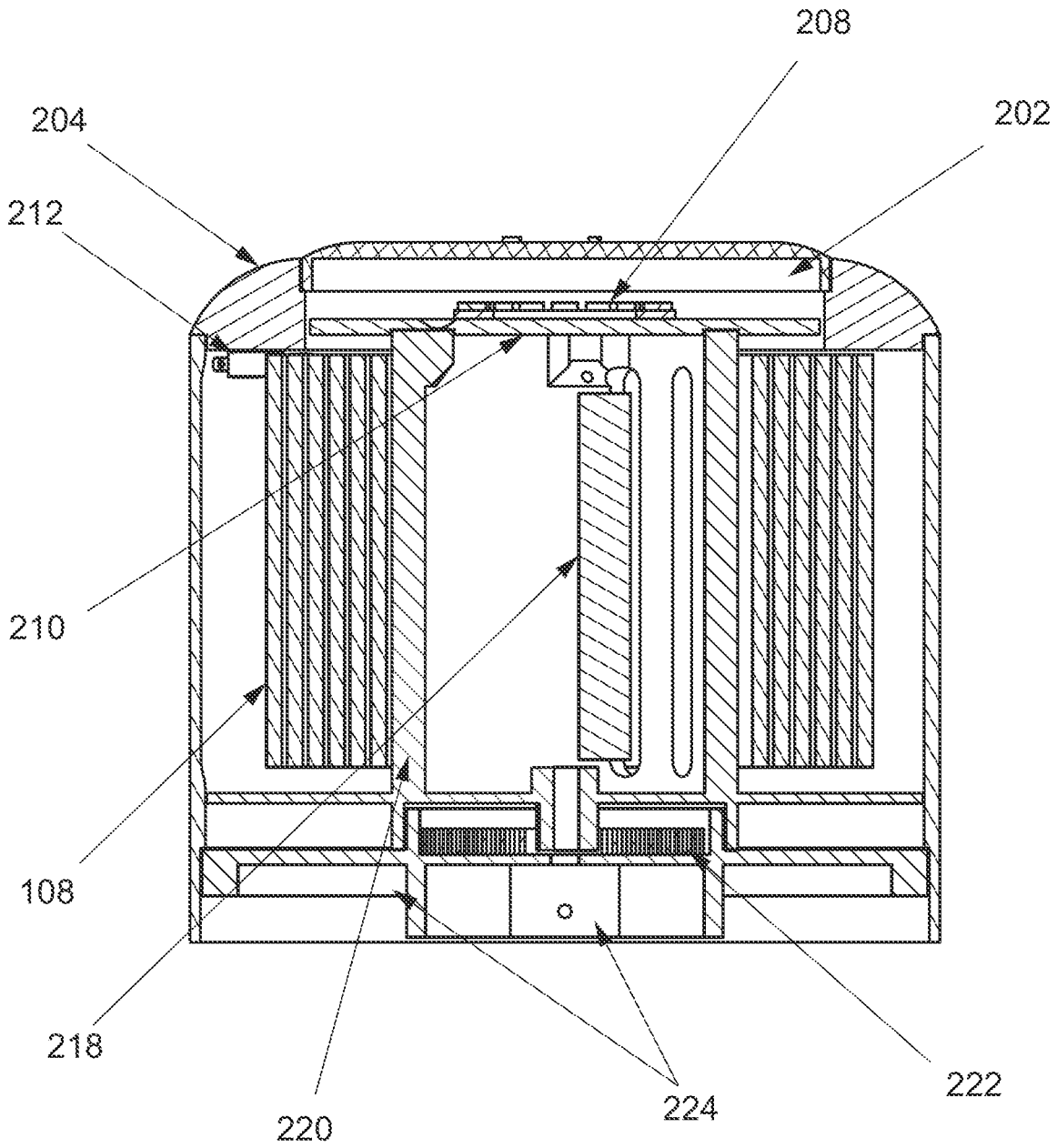
FIG. 4 illustrates a side elevation cross-sectional view of a stanchion head in accordance with an embodiment of the invention.

FIG. 4 illustrates a side elevation cross-sectional view of a stanchion head in accordance with an embodiment of the invention. In alternative embodiments of the invention which do not include stanchion units, the stanchion head may be referred to as a reel case unit 102. The stanchion head 102 comprises an outer reel case 204. On the top end of the stanchion head, a translucent cap top 202 made from a translucent material that will allow the said material to be lit up and change colors. In one embodiment, the translucent material is a plastic such as, but not limited to, high density polyethylene (HDPE). Such a top cap may function as an indicator for status (network, system, battery) and to accent messages displayed on the flexible LED stanchion ribbon display 108. It can have a logo imprinted on the top.

In embodiments of the invention, the stanchion head may use a RGB LED color ring 208 positioned beneath the top cap 102 and mounted to the reel cap 210. Such a top cap may function as an indicator for status (network, system, battery) and to accent messages displayed on the flexible LED stanchion ribbon display 108. It can have a logo imprinted on the top. The RGB LED color ring 208 is connected to a computer system 218 which also controls the operation of the stanchion head systems such as, but not limited to, the flexible LED stanchion ribbon display 108, process animation instructions wireless networking, battery status, and numerous other firmware or software instructions. In one embodiment of the invention, the RGB LED color ring 208 12 LED WS2812 based ring of addressable LEDs that will be controlled by the computer system 218 and used as an indicator for various statuses, and for providing an ambient, color matched or complementing glow to the top of the stanchion head 102.

In an embodiment of the invention, a ribbon reel body 220 acts as a container for the computer system 218 and the power supply and wiring associated with it. In an embodiment of the invention, the computer system is based on a NodeMCU ESP8266 chipset with built-in Wi-Fi Module and Arduino® GPIO hardware control. Persons having skill in the art will understand that numerous other microprocessor/microcontroller systems may be used to serve as a computer system 218. In embodiments of the invention, the power supply for certain wired embodiments of the invention current stanchion systems is a 5 v DC rated to 5A. In other embodiments of the invention, rechargeable battery powered systems can be configured to use 12 v DC for efficient recharging. In other embodiments of the invention, output of the batteries may be converted to 5*v* to run the Chipset and display. Persons having skill in the art will readily appreciate that numerous other power supply systems may be used to operate the stanchion system.

Figure 5:
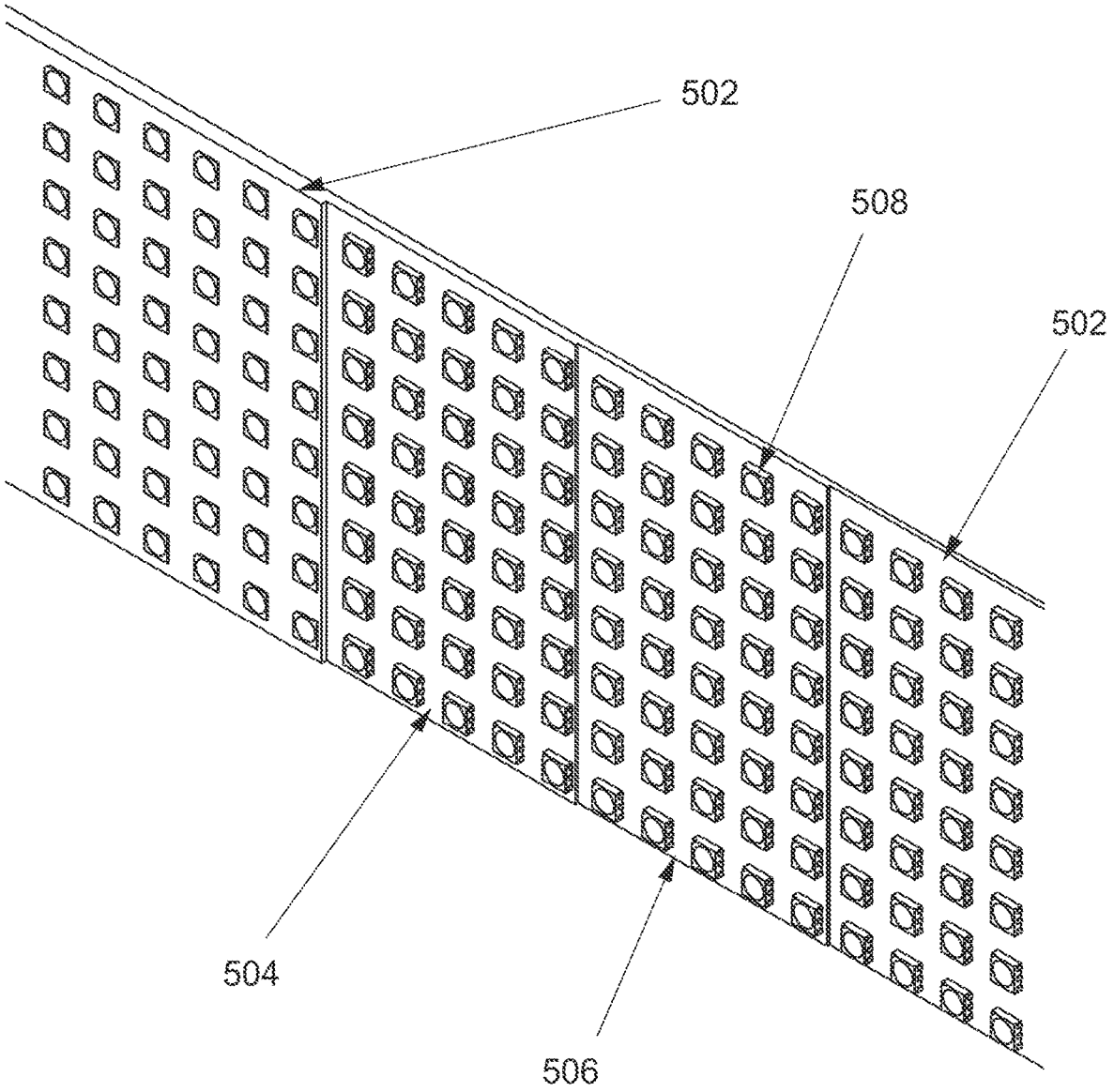
FIG. 5 illustrates a perspective view of a flexible LED stanchion ribbon display in accordance with an embodiment of the invention.

FIG. 5 illustrates a perspective view of a flexible LED stanchion ribbon display 108 in accordance with an embodiment of the invention. In one embodiment of the invention, the flexible LED stanchion ribbon display 108 is built of multiple layers. The first, or deepest, layer is a flexible printed circuit board 502 to the surface of which a matrix of RGB LEDs are mounted in an 8×8 pattern. In the preferred embodiment of the invention, each LED 508 is the 5050 SMD LED module. This type of LED is typically used for backlighting, home illumination, interior lighting, automobile lighting and many more types of lighting applications. Such LED units have 3 LED diodes in one housing (sometimes called tri-chips), and are capable of emitting brighter light than their contemporaries. Persons skilled in the art will appreciate that other types of LED matrices may be employed though.

In embodiments of the invention, a flexible printed circuit board 502 with WS2812 LED units surface mounted in 8×8 pattern arrays extend for the length of the LED stanchion ribbon display 108. Persons skilled in the art will readily appreciate that numerous flexible printed circuit boards are readily available and are well known and appreciated in the art.

Superior to the LED array is a diffusion layer 504 consisting of a light diffusing medium to help blend the multi-colored lights into a single color. The diffusion layer may consist of a flexible white diffusion material with similar transmissive properties to a white paper or vellum. Persons skilled in the art will understand that such a diffusion layer will serve to blend the RGB lights into a single color. Other embodiments of the invention may employ a silicone or other type of flexible coating to make the device water-proof or water-resistant.

The flexible LED stanchion ribbon display 108 may be wrapped by a fabric ribbon sleeve 506. In the preferred embodiment, the fabric ribbon sleeve 506 is made of variants of a flash spun high density polyethylene fiber. In the preferred embodiment, the fabric ribbon sleeve 506 consists of a black, durable, light transmissive woven fabric to act as the presentation layer for the RGB LED matrix. One such variant is sold under the trade name Tyvek® by the DuPont Corporation. The fabric ribbon sleeve 506 may provide contrast to the LEDs when lit, and hide them when not lit. This woven fabric will help add to the durability of the flexible LED stanchion ribbon display 108 by reducing friction and will help protect the LEDs and flexible printed circuit board from damage when being rolled into the housing.

Figure 6:
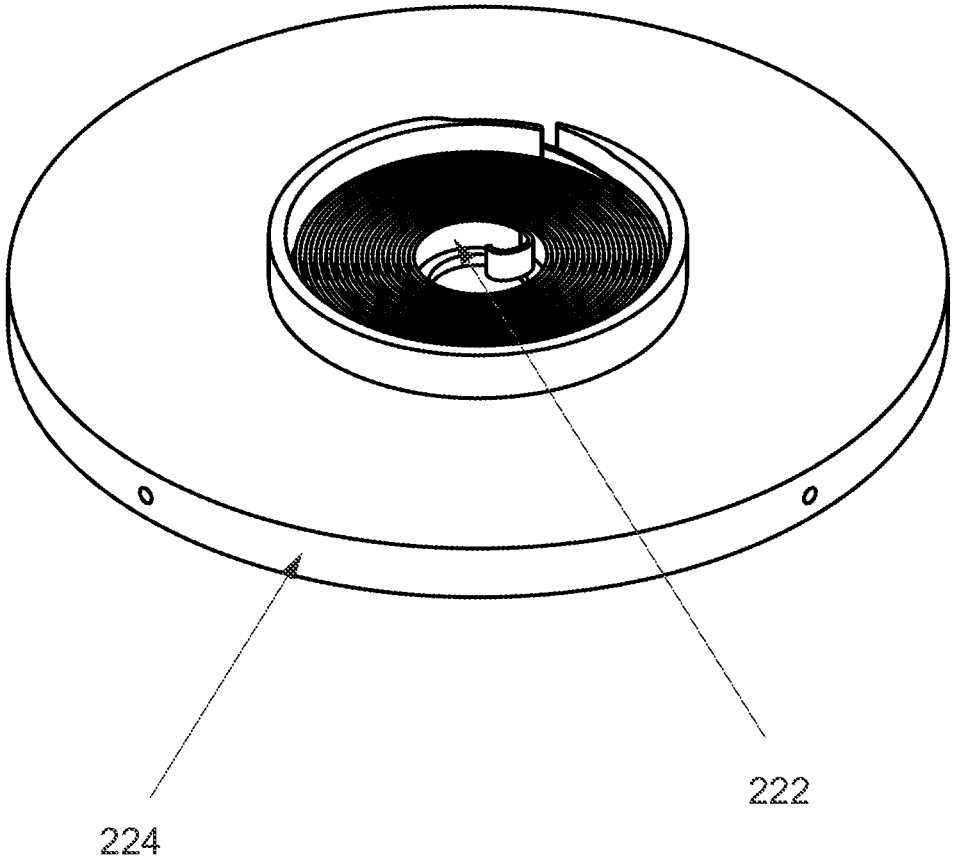
FIG. 6 illustrates a stanchion head spring cup with spring assembly in accordance with an embodiment of the invention.

FIG. 6 illustrates a stanchion head spring cup assembly 600 in accordance with an embodiment of the invention. On one end, the stanchion spring cup and pole mount 224 mounts to the top of the stanchion post of each stanchion unit. On the opposite end, the spring cup and pole mount 224 holds a retraction or recoil spring 222 in a stationary position. In embodiments of the invention, a reel case mounts to the spring cup 224. The retraction or recoil spring 222 serves as the winding mechanism to retract the flexible LED stanchion ribbon display into the stanchion head. Persons having skill in the art will appreciate that such retraction or recoil springs may be made of a metal such as, but not limited to, steel. It will become further apparent to those having skill in the art that the stanchion spring cup may be made of a rigid material such as, but not limited to, an impact resistant plastic.

Figure 7:
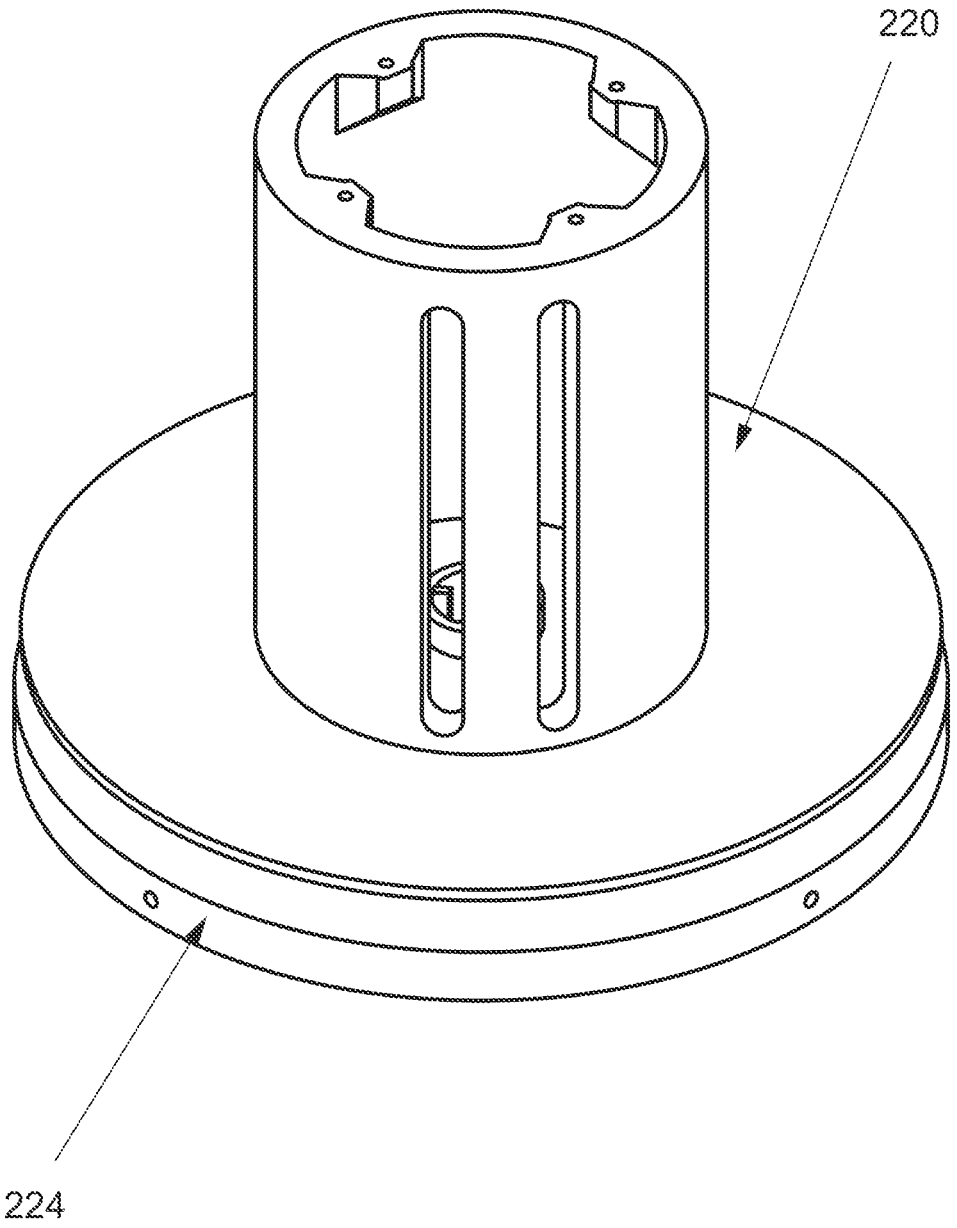
FIG. 7 illustrates a stanchion head reel mounted to the spring cup with spring assembly in accordance with an embodiment of the invention.

FIG. 7 illustrates a stanchion head reel mounted to the spring cup with spring assembly in accordance with an embodiment of the invention. On one end, the stanchion spring cup and pole mount 224 mounts to the top of the stanchion post of each stanchion unit. The spring cup and pole mount 224 holds a steel recoil spring 224 in a stationary position. In embodiments of the invention, a reel case 204 mounts to the spring cup 224. The retraction or recoil spring 222 serves as the winding mechanism to retract the flexible LED stanchion ribbon display into the stanchion head. The ribbon reel body 220 connects to the spring cup and pole mount 224 in such a way that the reel body can allow for the flexible LED stanchion ribbon to extend from and retract into the stanchion head. The ribbon reel body also serves as a protective housing for the computer system which controls the flexible LED stanchion ribbon display.

Figure 8:
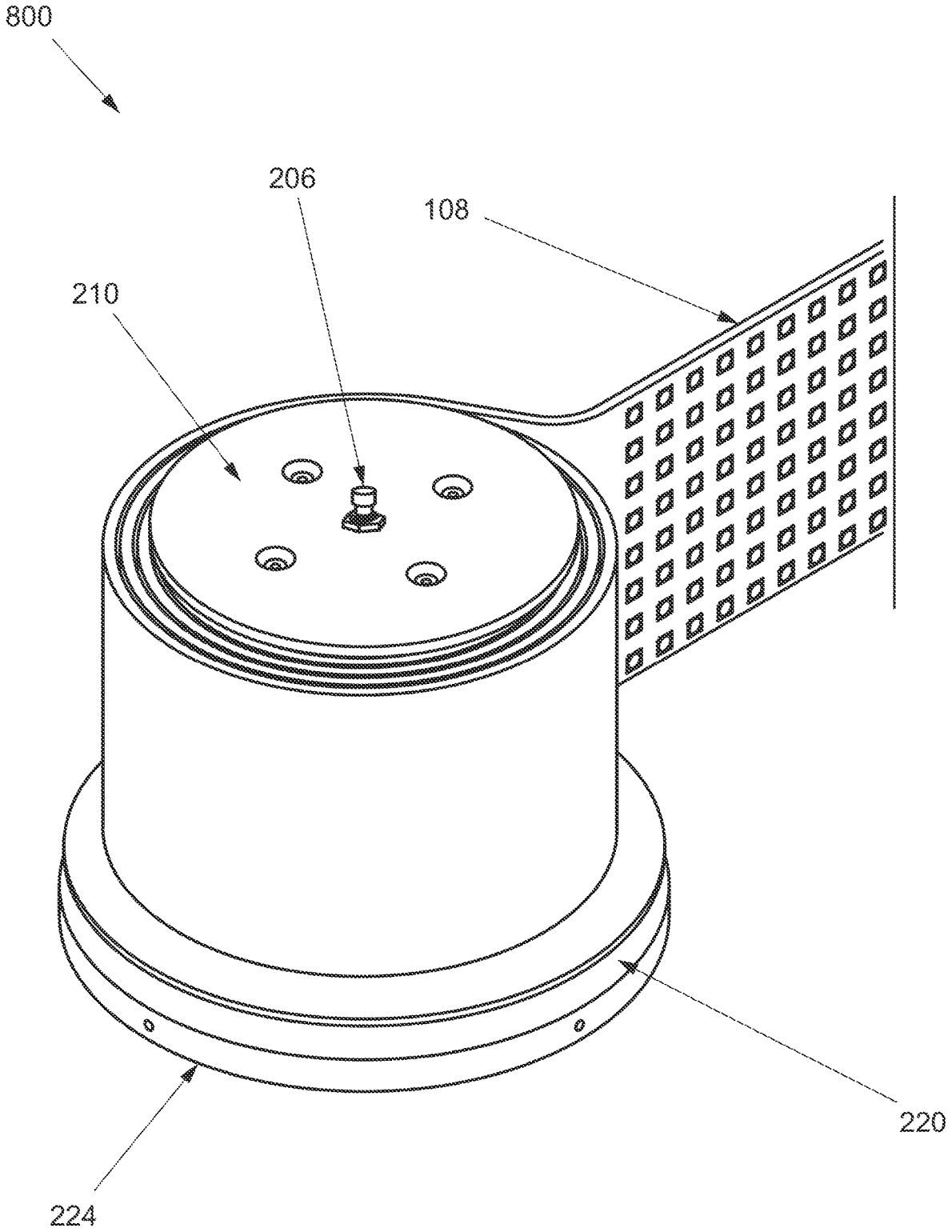
FIG. 8 illustrates a stanchion head reel loaded with flexible stanchion ribbon display mounted to the spring cup with spring assembly in accordance with an embodiment of the invention.

FIG. 8 illustrates a stanchion head reel assembly 800 loaded with flexible stanchion ribbon display mounted to the spring cup with spring assembly in accordance with an embodiment of the invention. Shown are the stanchion spring cup and pole mount 224, the reel case 204, and the reel cap 210 with the flexible LED stanchion ribbon display wound around the reel case 204. In embodiments of the invention, the retraction or recoil spring 222 serves as the winding mechanism to retract the flexible LED stanchion ribbon display 108 into the stanchion head. The retraction or recoil spring 222 engages a small tab on the inside of the ribbon reel body 220. As the ribbon reel body 220 is turned, the retraction or recoil spring 222 is wound tighter and tighter, providing the recoil necessary to keep the flexible LED stanchion ribbon display 108 wound onto the ribbon reel body 220.

Figure 9:
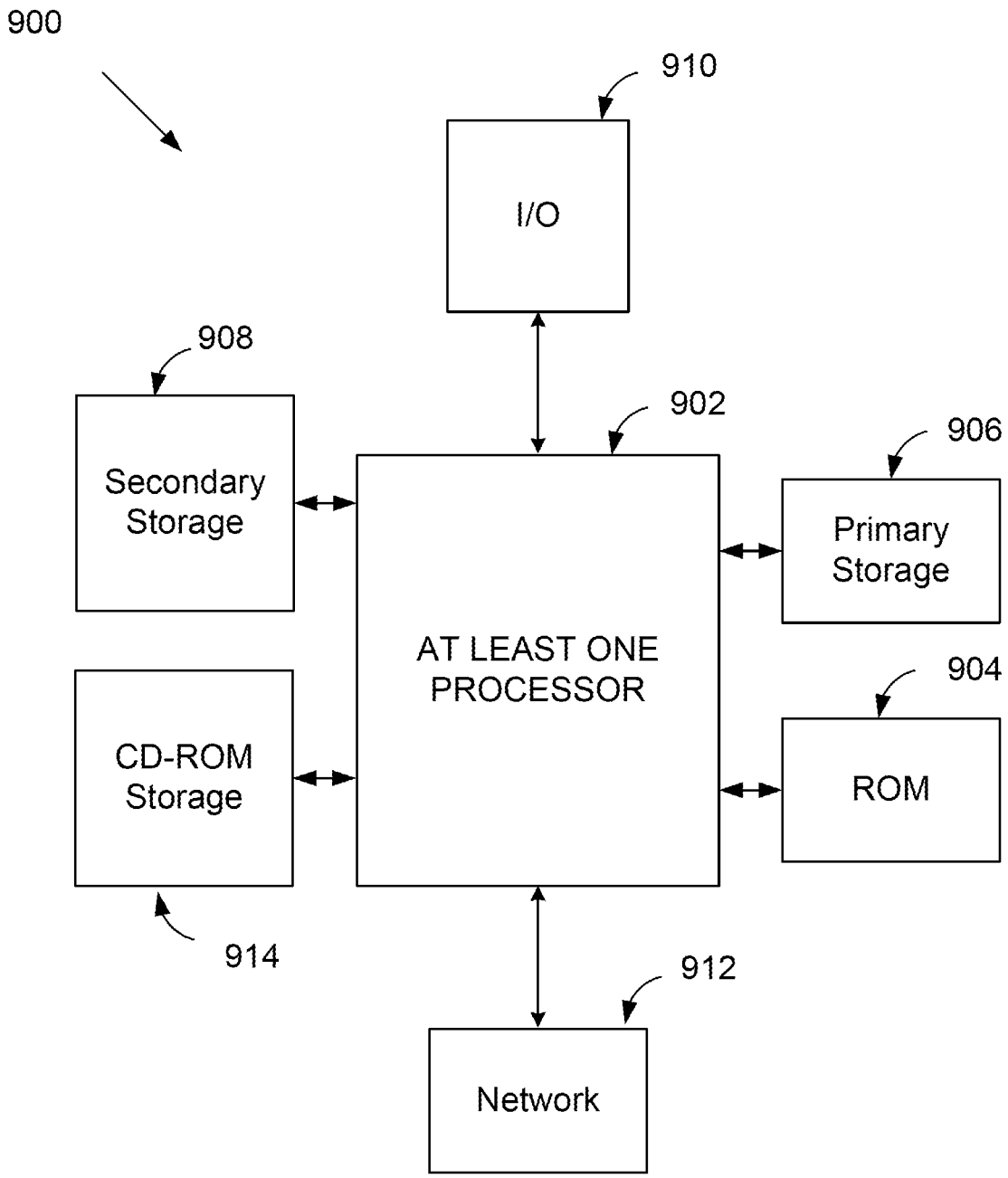
FIG. 9 illustrates a block diagram depicting a computer system that, when appropriately configured or designed, may serve as a computer system or for which the retractable stanchion barrier with flexible RGB display matrix may be embodied.

FIG. 9 illustrates a block diagram depicting a computer system that, when appropriately configured or designed, may serve as a computer system 900 or for which the retractable stanchion barrier with flexible RGB display matrix may be embodied.

The computer system 900 includes at least one processor 902 (also referred to as central processing units, or CPUs) that may be coupled to storage devices including a primary storage 906 (typically a random-access memory, or RAM), a primary storage 904 (typically a read-only memory, or ROM). The CPU 902 may be of various types including micro-controllers (e.g., with embedded RAM/ROM) and microprocessors such as programmable devices (e.g., RISC or CISC based, or CPLDs and FPGAs) and devices not capable of being programmed such as gate array ASICs (Application Specific Integrated Circuits) or general purpose microprocessors. As is well known in the art, primary storage 904 acts to transfer data and instructions uni-directionally to the CPU and primary storage 906 typically may be used to transfer data and instructions in a bi-directional manner. The primary storage devices discussed previously may include any suitable computer-readable media such as those described above. A mass storage device 908 may also be coupled bi-directionally to CPU 902 and provides additional data storage capacity and may include any of the computer-readable media described above. Mass storage device 908 may be used to store programs, data and the like and typically may be used as a secondary storage medium such as a hard disk. It will be appreciated that the information retained within mass storage device 908, may, in appropriate cases, be incorporated in standard fashion as part of primary storage 906 as virtual memory. A specific mass storage device such as, but not limited to, a flash memory device or CD-ROM 914 may also pass data uni-directionally to the CPU.

The CPU 902 may also be coupled to an interface 910 that connects to one or more input/output devices such as such as video monitors, LED displays, LED RGB displays, OLED displays, holographic displays, switches, sensors, track balls, mice, keyboards, microphones, touch-sensitive displays, transducer card readers, magnetic or paper tape readers, tablets, styluses, voice or handwriting recognizers, or other well-known input devices such as, of course, other computers. In embodiments of the present invention, the CPU I/O interface 910 is coupled chiefly to the flexible LED stanchion ribbon display 108 along with switch and sensor mechanisms. Finally, CPU 502902 optionally may be coupled to an external device such as a database or a computer or telecommunications or internet network using an external connection shown generally as a network 512912, which may be implemented as a hardwired or wireless communications system as shown and described in FIG. 10 using suitable conventional technologies. With such a connection, the CPU might receive information from the network, or might output information to the network in the course of performing operations such as sending messages, signals and/or graphics to the various components of the retractable stanchion barrier with a flexible LED RGB display matrix.

Figure 10:
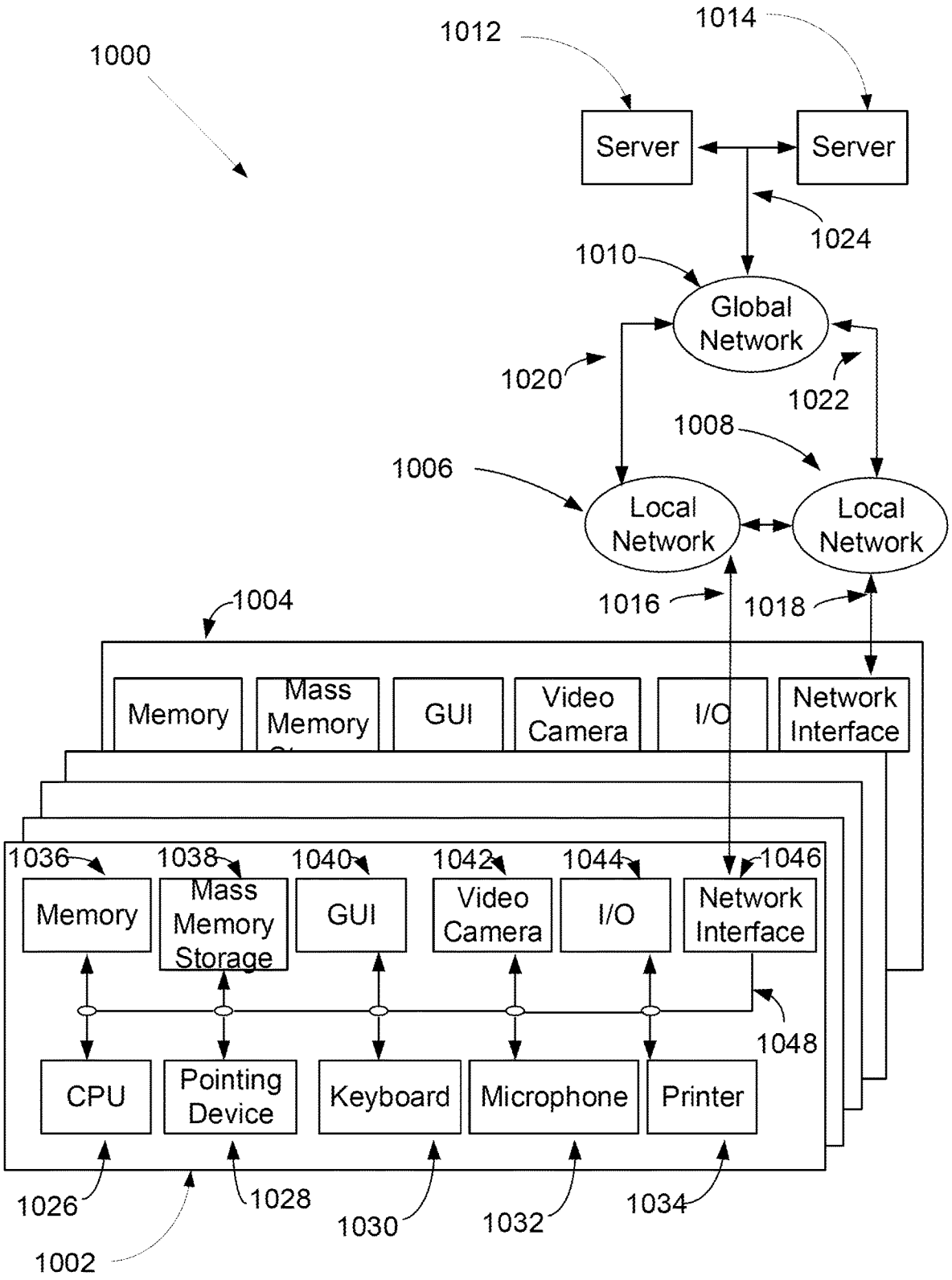
FIG. 10 illustrates a block diagram depicting a conventional client/server communication system in which the retractable stanchion barrier with flexible RGB matrix may be embodied.

FIG. 10 illustrates a block diagram depicting a conventional client/server communication system in which embodiments of the retractable stanchion barrier with flexible RGB matrix may be embodied. Persons having skill in the art will understand that such a communication system may be configured to program the retractable stanchion barrier with flexible RGB matrix from different computing platforms such as, but not limited to, smartphones, tablets, desktop computers, laptop computers and network servers.

A communication system 1000 includes a multiplicity of clients with a sampling of clients denoted as a client 1002 and a client 1004, a multiplicity of local networks with a sampling of networks denoted as a local network 1006 and a local network 1008, a global network 1010 and a multiplicity of servers with a sampling of servers denoted as a server 1012 and a server 1014. Embodiments include, but are not limited to, laptop computers, desktop computers, tablets, smartphones or any other device with an electronic user interface.

Client 1002 may communicate bi-directionally with a local network 1006 via a communication channel 1016. Client 1004 may communicate bi-directionally with local network 1008 via a communication channel 1018. Local network 1006 may communicate bi-directionally with global network 1010 via a communication channel 1020. Local network 1008 may communicate bi-directionally with global network 1010 via a communication channel 1022. Global network 1010 may communicate bi-directionally with server 1012 and server 1014 via a communication channel 1024. Server 1012 and server 1014 may communicate bi-directionally with each other via communication channel 1024. Furthermore, clients 1002, 1004, local networks 1006, 1008, global network 1010 and servers 1012, 1014 may each communicate bi-directionally with each other.

In one embodiment, a global network 1010 may operate as the Internet or World Wide Web (WWW). It will be understood by those skilled in the art that a communication system 1000 may take many different forms. Non-limiting examples of forms for communication system 1000 include local area networks (LANs), wide area networks (WANs), wired telephone networks, wired networks, wireless networks, near field communication (NFC), internet of things (IoT) or any other network supporting data communication between respective entities.

Clients 1002 and 1004 may take many different forms. Non-limiting examples of clients 1002 and 1004 include retractable stanchion barriers with flexible RGB matrices personal computers, personal digital assistants (PDAs), cellular phones, tablets, and smartphones. As represented, each Client assumes the form of a general computing device such as a laptop, smartphone or tablet. However, in the present invention, the clients may be the computer systems in individual stanchion heads. Persons having skill in the art will readily appreciate that hardware peripherals need not be specific.

Client 1002 includes a CPU 1026, and may include a pointing device 1028, a keyboard 1030, a microphone 1032, a printer 1034, a memory 1036, a mass memory storage 1038, a GUI 1040, a video camera 1042, an input/output interface 1044 and a network interface 1046. Client 1002 may also include a stanchion head system as defined above.

The CPU 1026, pointing device 1028, keyboard 1030, microphone 1032, printer 1034, memory 1036, mass memory storage 1038, GUI 1040, video camera 1042, input/output interface 1044 and network interface 1046 may communicate in a unidirectional manner or a bi-directional manner with each other via a communication channel 1048. The communication channel 1048 may be configured as a single communication channel or a multiplicity of communication channels.

The CPU 1026 may be comprised of a single processor or multiple processors. The CPU 1026 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors.

As is well known in the art, memory 1036 is used typically to transfer data and instructions to CPU 1026 in a bi-directional manner. Memory 1036, as discussed previously, may include any suitable computer-readable media, intended for data storage, such as those described above excluding any wired or wireless transmissions unless specifically noted. Mass memory storage 1038 may also be coupled bi-directionally to CPU 1026 and provides additional data storage capacity and may include any of the computer-readable media described above. Mass memory storage 1038 may be used to store programs, data and the like and is typically a secondary storage medium such as a hard disk. It will be appreciated that the information retained within mass memory storage 1038, may, in appropriate cases, be incorporated in standard fashion as part of memory 1036 as virtual memory.

The CPU 1026 may be coupled to numerous hardware components understood in the art. The CPU 1026 may be coupled to a graphical user interface (GUI) 1040. A GUI 1040 enables a user to view the operation of computer operating system and software. The CPU 1026 may be coupled to a pointing device 1028. Non-limiting examples of a pointing device 1028 include computer mouse, trackball and touchpad. A pointing device 1028 enables a user with the capability to maneuver a computer cursor about the viewing area of GUI 1040 and select areas or features in the viewing area of GUI 1040. The CPU 1026 may be coupled to a keyboard 1030. A keyboard 1030 enables a user with the capability to input alphanumeric textual information to the CPU 1026. The CPU 1026 may be coupled to a microphone 1032. A microphone 1032 enables audio produced by a user to be recorded, processed and communicated by the CPU 1026. The CPU 1026 may be connected to a printer 1034. A Printer 1034 enables a user with the capability to print information to a sheet of paper. The CPU 1026 may be connected to a video camera 1042. A Video camera 1042 enables video produced or captured by a user to be recorded, processed and communicated by CPU 1026.

The CPU 1026 may also be coupled to an input/output interface 1044 that connects to one or more input/output devices such as, but not limited to, CD-ROM, video monitors, track balls, mice, keyboards, microphones, touch-sensitive displays, transducer card readers, magnetic or paper tape readers, tablets, styluses, voice or handwriting recognizers, or other well-known input devices such as other computers an input/output devices known in the art.

Finally, the CPU 1026 optionally may be coupled to a network interface 1046 which enables communication with an external device such as a database or a computer or telecommunications or internet network using an external connection shown generally as communication channel 1016, which may be implemented as a hardwired or wireless communications link using suitable conventional technologies. With such a connection, the CPU 1026 may receive information from the network, or might output information to a network in the course of performing the method steps described in the teachings of the present invention.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the retractable stanchion barrier with a flexible LED RGB display matrix, other equivalent or alternative methods of implementing the retractable stanchion barrier with a flexible LED RGB display matrix according to the present invention will be apparent to those skilled in the art. Various aspects of the invention have been described above by way of illustration, and the specific embodiments disclosed are not intended to limit the invention to the particular forms disclosed. The particular implementation of the retractable stanchion barrier with a flexible LED RGB display matrix may vary depending upon the particular context or application. By way of example, and not limitation, the retractable stanchion barrier with a flexible LED RGB display matrix described in the foregoing was principally directed to pedestrian barriers. However, similar techniques may instead be applied to other handheld devices which implementations of the present invention are contemplated as within the scope of the present invention. Such possibilities include, but are not limited to, police and/or military use. Further alternative embodiments of the present invention may include different types of connections and varying width LED stanchion ribbons. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the retractable stanchion barrier with a flexible LED RGB display matrix are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A stanchion display system comprising one or more reel case units, each reel case unit consisting of:

a) a top cap;
b) a reel cap;
c) a feed length detection switch;
d) a retraction spring;
e) a ribbon reel body;
f) a spring cup and pole mount;
g) a flexible LED stanchion ribbon display which extends from and retracts into the said reel case; and
h) a computer system having at least one processor and memory, said memory including computer executable instructions which, when executed by the said at least one processor cause the at least one processor to:
1) Allow for a user to input display information;
2) Store inputted display information in memory;
3) Allow for a user to verify the inputted display information;
4) Allow for a user to edit the inputted display information;
5) display the inputted display information on one or more stanchion units;
6) Perform multimedia functions.

2. The stanchion display system as recited in claim 1 wherein each flexible LED stanchion ribbon display consists of:

a) a flexible printed circuit board;
b) a LED matrix consisting of one or more RGB LED modules;
c) a diffusion layer;
d) a ribbon sleeve; and
e) a connecter.

3. The stanchion display system as recited in claim 2 wherein the connecter is positioned at the distal or terminal end of the said flexible LED stanchion ribbon display.

4. The stanchion display system as recited in claim 1 wherein each stanchion unit has a stanchion ribbon connection, said stanchion ribbon connection capable of mating with a connecter.

5. The stanchion display system as recited in claim 1 wherein the top cap is a translucent material.

6. The stanchion display system as recited in claim 1 wherein the stanchion head has a control switch capable of controlling the functions of the said stanchion head.

7. The stanchion display system as recited in claim 1 wherein the computer system governs the functions of the flexible LED stanchion ribbon display.

8. The stanchion display system as recited in claim 1 wherein the computer system governs the functions of the RGB LED color ring.

9. The stanchion display system as recited in claim 1 wherein the computer system is programmed and accessed through a network.

10. The stanchion display system as recited in claim 1 wherein the spring cup and pole mount connects with a stanchion pole.

11. A method for crowd control and line management using a stanchion display system utilizing one or more stanchion units, each stanchion unit having a stanchion head, each said stanchion head comprising a top cap; a reel cap; a feed length detection switch; a retraction spring; a ribbon reel body; a spring cup and pole mount; a flexible LED stanchion ribbon display which extends from and retracts into the said reel case; and a computer system; the method comprising the steps of:

a) a user inputting display information;
b) storing inputted display information in memory;
c) a user verifying the inputted display information;
d) a user editing the inputted display information;
e) the inputted display information being displayed on one or more stanchion units; and
f) a user selecting additional multimedia features.

* * * * *